US007267936B2

(12) United States Patent
Gray et al.

(10) Patent No.: US 7,267,936 B2
(45) Date of Patent: Sep. 11, 2007

(54) PHOTOGRAPHIC ELEMENT

(75) Inventors: Colin J. Gray, Wealdstone (GB); Martin T. Day, Colney Heath (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/557,653

(22) PCT Filed: Apr. 30, 2004

(86) PCT No.: PCT/GB2004/001893

§ 371 (c)(1),
(2), (4) Date: Nov. 21, 2005

(87) PCT Pub. No.: WO2004/109394

PCT Pub. Date: Dec. 16, 2004

(65) Prior Publication Data

US 2007/0065761 A1 Mar. 22, 2007

(30) Foreign Application Priority Data

Jun. 7, 2003 (GB) ..... 0313159.6

(51) Int. Cl.
*G03C 1/83* (2006.01)
*G03C 1/825* (2006.01)
*G03C 11/22* (2006.01)

(52) U.S. Cl. ..... 430/496; 430/517; 430/522

(58) Field of Classification Search ..... 430/496, 430/517, 522
See application file for complete search history.

(56) References Cited

U.S. PATENT DOCUMENTS

| | | | |
|---|---|---|---|
| 4,957,856 | A | 9/1990 | Suematsu et al. |
| 5,015,562 | A | 5/1991 | Toya et al. |
| 5,366,845 | A | 11/1994 | Inoue et al. |
| 5,910,398 | A | 6/1999 | Schmidt et al. |
| 6,228,569 | B1 | 5/2001 | Maier et al. |

FOREIGN PATENT DOCUMENTS

| | | |
|---|---|---|
| EP | 0 582 000 | 2/1994 |
| JP | 06-208189 | 7/1994 |
| JP | 07-005629 | 1/1995 |

*Primary Examiner*—Richard L. Schilling
(74) *Attorney, Agent, or Firm*—Andrew J. Anderson; Paul A. Leipold

(57) ABSTRACT

The invention provides a photographic element, comprising a support, a photographic emulsion layer and, an antihalation underlayer and/or a pelloid layer, the antihalation underlayer and/or pelloid layer being present in an amount of 1 $g/m^2$ or less and comprises a vehicle and a solid particle dye.

26 Claims, No Drawings

PHOTOGRAPHIC ELEMENT

FIELD OF THE INVENTION

The present invention relates to a photographic element and in particular to a photographic element having an antihalation underlayer (AHU) and/or a pelloid layer. The invention also relates to a method of manufacturing a photographic element having an antihalation underlayer.

BACKGROUND OF THE INVENTION

In an image captured on a photographic element such as film, halation is the unwanted exposure surrounding the image of a bright object cased by light reflected from the rear surface of the film support. It is known to reduce the halation effect with the use of an AHU provided in the film to absorb unwanted reflected light.

To meet the requirements of modern, high-speed coating facilities, the thickness of the AHU is increased to ensure good quality coating and to carry a dye to absorb all the reflected light. Single sided films manufactured for the Printed Circuit Board (PCB) market may contain such an AHU. Typically the AHU contains a solid particle dye and can also contain other photographic addenda such as a sequestrant to complex with iron and copper to reduce the risk of 'spotting', especially in aged film. A typical dry coverage for such an AHU is approximately 2 g/m$^2$ of material, usually made up of a mixture of gelatin and latex copolymer. Use of an AHU as opposed to a so-called 'pelloid' layer, which is an antihalation layer provided on the opposite side of the base from that on which the emulsions are provided, allows a single sided film with improved dimensional stability as a result of a reduced humidity expansion coefficient (HEC) due to the option of coating lower overall material coverages than conventional two-sided products.

Despite the improved dimensional stability resulting from the reduced humidity expansion coefficient provided by single sided films with AHUs, the thickness of the AHU can lead to undesirable consequences such as humidity curl and a high cost of manufacture due to relatively large amounts of material being required.

U.S. Pat. No. 5,910,398 (Schmidt et al), discloses a method of manufacturing a photographic glass plate having an antihalation layer. U.S. Pat. No. 4,957,856 (Suematsu et al), discloses a silver halide photographic material having a light-sensitive silver halide emulsion layer and a subbing layer including a dye. U.S. Pat. No. 5015562 (Toya et al) discloses a light sensitive material comprising a support having thereon at least one light-sensitive silver halide emulsion layer. At least one layer including a mordant or a dye is also provided.

A problem with photographic films for use in graphic arts and in the manufacture of PCBs is that regardless of whether a pelloid layer or an antihalation underlayer is utilised, or both, there remains a degree of dimensional instability with temperature and/or humidity, which is particularly problematic if a multi-layer assembly is intended to result, for example in the manufacture of PCBs, where misalignment can occur.

Typically, customers are advised to store and, preferably use, the films in ambient conditions, such as at 50% RH and 21° C.

PROBLEM TO BE SOLVED BY THE INVENTION

It would be desirable to provide a photographic element that addresses the problems identified above. In particular, a photographic element is desired that provides good antihalation properties with increased dimensional stability i.e. reduced humidity and/or temperature expansion coefficients. More particularly, a photographic element is desired that is less susceptible to dimensional instability with temperature and/or humidity when the element is transported, stored and/or used in less rigorously controlled conditions.

SUMMARY OF THE INVENTION

According to a first aspect of the present invention, there is provided a photographic element for use in graphic arts or in the manufacture of PCBs, which photographic element comprises a support, a photographic emulsion layer and at least one of an antihalation underlayer and a pelloid layer, each of which antihalation underlayer and pelloid layer being present in an amount of 1 g/m$^2$ or less and comprising a vehicle and a solid particle dye.

According to a second aspect of the present invention, there is provided a method of manufacturing a photographic element for use in graphic arts or in the manufacture of PCBs, said method comprising coating a support with an antihalation underlayer in an amount of 1 g/m$^2$ or less, said antihalation underlayer comprising a vehicle and a solid particle dye; and coating said antihalation underlayer with at least one photographic emulsion layer, wherein the antihalation underlayer and the at least one photographic emulsion layer are coated separately.

According to a third aspect of the invention, there is provided a method of manufacturing a photographic element for use in graphic arts or in the manufacture of PCBs, said method comprising coating a support with an antihalation underlayer in an amount of 1 g/m$^2$ or less, said antihalation underlayer comprising a vehicle, a solid particle dye and a thickening agent compatible with the vehicle; and coating said antihalation underlayer with at least one photographic emulsion layer, wherein the antihalation underlayer and the at least one photographic emulsion layer(s) are coated substantially simultaneously in a multi-layer coating system.

According to a fourth aspect of the invention there is provided the use of a thickening agent to control the viscosity of a material for use as an antihalation underlayer, said material comprising a vehicle and a solid particle dye, independently of the wet coverage ability of said material, whereby a coating of said material in an amount of 1 g/m$^2$ or less may be applied to a support simultaneously with at least one photographic emulsion layer to be coated thereon.

ADVANTAGEOUS EFFECT OF THE INVENTION

The present invention provides a photographic element having good antihalation properties using an antihalation underlayer and/or pelloid layer substantially thinner and lower in mass per square meter than conventional antihalation underlayers. Preferably, the photographic element of the present invention maintains antihalation properties by utilizing an antihalation underlayer without also utilizing a pelloid layer, thereby allowing the benefits and other advantages of a single sided film to be achieved.

In a typical example the present invention enables the use of up to 0.9 g less gelatin and up to 1.0 g less latex copolymer solids per square meter than used in conventional films. This reduction in vehicle mass brings about a number of consequential benefits. For example, dimensional stability is improved due to the reduced thickness brought about by a reduction in mass per square meter of the antihalation layer. These benefits improve both temperature and humidity dependent dimensional stability by reducing the contribution of the antihalation layer to the overall humidity expansion coefficient of the element. Excellent dimensional stability is particularly strived for in Printed Circuit Board (PCB) films, making the photographic element of the present invention particularly suitable for such applications.

In comparison to conventional photographic elements having antihalation underlayers, a lesser amount of vehicle is utilized, which also reduces unit manufacturing costs.

Reducing the amount of coated vehicle in an element coated on only one side of the support also reduces the total loading on the single coated side. This reduces humidity curl compared to conventional films. Most PCB films are handled at 50+/−3% RH, and single-sided products do not curl at this humidity. However, if the user's operating conditions are such that the RH is poorly controlled, then the photographic element of the present invention will display less curl than conventional PCB films, especially at low RHs.

DETAILED DESCRIPTION OF THE INVENTION

The present invention provides a photographic element for use in graphic arts or in the manufacture of PCBs, which element has a thin antihalation underlayer and/or pelloid layer. The photographic element is formed on a support material such as polyethylene terephthalate, acetate, reflective paper, aluminium etc. Supports for the photographic elements can be transparent or reflective (for example, a paper support). Such supports include polymeric films such as cellulose esters (for example, cellulose triacetate and diacetate) and polyesters of dibasic aromatic carboxylic acids with divalent alcohols (for example, poly(ethylene-terephthalate), poly(ethylene-naphthalates)), paper and polymer coated paper. Preferably the support is a transparent film suitable for use in graphic arts or in the manufacture of PCBs.

The photographic element may have an antihalation underlayer, located between the support and the at least one photographic emulsion layer, or a pelloid layer, located on the side of the support opposite the side on which the at least one photographic emulsion layer is coated, or both. The pelloid layer is of particular utility when the support is a transparent film. Preferably, however, the photographic element comprises an antihalation underlayer but does not comprise a pelloid layer.

Useful vehicles in an antihalation underlayer and/or pelloid layer of a photographic element according to the present invention include both naturally occurring substances such as proteins, protein derivatives, cellulose derivatives (e.g. cellulose esters), gelatin (e.g., alkali-treated gelatin such as cattle bone or hide gelatin or acid treated gelatin such as pigskin gelatin) and synthetic vehicle substances. Gelatin derivatives could also be used such as acylated gelatin, phthalated gelatin, oxidized gelatin, and diamine derivatized gelatin.

Also useful as vehicles or vehicle extenders are hydrophilic water-permeable colloids. These include synthetic polymeric peptizers, carriers, and/or binders such as poly (vinyl alcohol), poly(vinyl lactams), acrylamide polymers, polyvinyl acetals, polymers of alkyl and sulphoalkyl acrylates and methacrylates, hydrolysed polyvinyl acetates, polyamides, polyvinyl pyrrolidone, methacrylamide copolymers, and the like, latex copolymer or cellulose derivatives such as carboxymethyl cellulose. A mixture of any two or more of all the materials listed could also be used as the vehicle.

A vehicle for use in accordance with the present invention may further comprise a latex copolymer mixture. For example, the vehicle may comprise a gelatin and a latex copolymer mixture. Alternatively, for example, the vehicle may simply be a gelatin.

Typically, the antihalation underlayer and/or pelloid layer consists of an ultra-thin layer of a vehicle, e.g. a carrier, such as gelatin (e.g. 0.1 g gelatin per square meter) containing with the gelatin only a dye such as a solid particle dye, in place of the typical 2 g vehicle per square meter AHU.

The photographic element of the invention comprises one or more photographic silver halide emulsion layers coated onto the antihalation underlayer or, where an element with only a pelloid layer is to be formed, onto the side of the support opposite to that of the antihalation pelloid layer.

A solid particle dye is preferred for the AHU since if a soluble dye or dyes were to be used there would be a risk of contamination of the emulsion layers during any re-wetting stage. Suitable solid particle dyes include, for example, dyes having a structure according to Formula 1 or Formula 2:

Formula 1

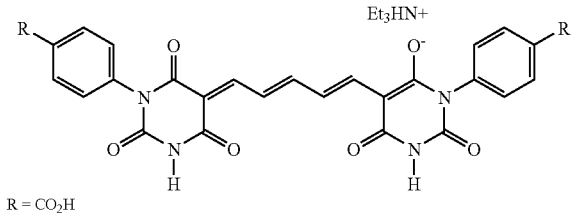

Formula 2

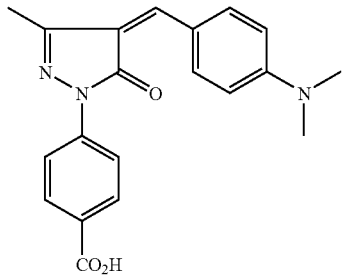

A protective supercoat can be coated simultaneously or subsequently, preferably simultaneously, on top of the one or more photographic silver halide emulsion layers.

The photographic element according to the invention may further comprise a thickening agent, such as, for example, sodium polystyrene sulphamate, which can be used to control the viscosity of the material, comprising a vehicle and a dye for use as an antihalation underlayer (or as a pelloid layer) whereby a coating of said material in an amount of 1 $g/m^2$ or less can be applied to a support as an antihalation underlayer simultaneously with at least one photographic emulsion layer to be coated thereon. The thickening agent selected of course is preferably compatible with the vehicle to be used, e.g. a particular gelatin or gelatin-derived vehicle.

As will be explained below any suitably adapted coating system may be used to coat the antihalation underlayer and/or pelloid layer and the remaining layers of the photographic element. For example a curtain coating system may be used or alternatively a bead coating system could be used.

In order to coat such a thin antihalation underlayer (i.e. less than 1 $g/m^2$) and at least one photographic emulsion layer, it is necessary to either coat the antihalation underlayer separately from the photographic emulsion layer(s) coated thereon or to control the viscosity of the antihalation underlayer to enable it to be coated simultaneously with the photographic emulsion layers. Where the antihalation underlayer is to be coated simultaneously with at least one photographic emulsion layer, it is necessary that the viscosity of the antihalation underlayer be controlled to enable the antihalation underlayer to form a good even coating whilst maintaining the wet coverage of the antihalation underlayer. One way by which this can be achieved is to utilise an antihalation underlayer which comprises a thickening agent, such as sodium polystyrene sulphamate, that is compatible the vehicle used. In this way, the viscosity can be increased and wet coverage maintained at a sufficiently high level to allow simultaneous coating of such an antihalation underlayer with at least one photosensitive emulsion layer. Where the antihalation underlayer is to be coated separately from the at least one photosensitive emulsion layer, the antihalation underlayer may be coated, for example, at a first of a two station coating system and the emulsion layer(s) coated at a second station, or the antihalation underlayer may be coated in a first pass of a single station coating system whilst the emulsion layer(s) is coated in a second pass.

The antihalation underlayer and/or pelloid layer and photosensitive emulsion layer(s) are typically coated in aqueous media and then dried to form the respective layers on the support.

In one example, the ultra-thin AHU would be coated at coater 1 of a 2-coating station track, and dried, before the coating of the remaining conventional layers at coater 2. Indeed, by utilising coater 1 of a 2-coater machine, there will be less tendency to induce electrical charge on the film support before it reaches coater 2 for application of the conventional layers of the film, compared with coating all layers at coater 2.

The ultra-thin AHU is usually formed on the same side of the support as the one or more photographic layers, between the support and the one or more photographic layers. It will be appreciated that the antihalation layer can also be formed on the opposite side of the support from that on which the one or more photographic layers are formed in order to provide a pelloid layer. Given the ultra-thin nature of such a pelloid layer, the photographic element still functions as if it were a single-sided photographic element in terms of its dimensional stability.

The aqueous solution for coating at coater 1 would contain gelatin, the solid particle dye, possibly one or more of a thickener, a latex copolymer and a surfactant (such as Aerosol OT®) that is compatible with the re-wetting process at coater 2. The dry gelatin coverage of the ultra-thin AHU of 0.1 g/m$^2$ is more typical of so-called gelatin subbing layers that are more usually applied during the manufacture of the polyethylene terephthalate film base. This illustrates the unusually thin antihalation layer that is used in the photographic element of the present invention, with the incorporation of a solid particle dye in the vehicle, which unlike soluble dyes or photographic addenda do not crystallise in the low gelatin environment.

Addenda such as a sequestrant, normally present in the conventional AHU, may be repositioned into one of the other layers such as an emulsion layer, a protective overcoat layer (also known as a supercoat), or an interlayer positioned between any of the aforementioned layers.

The antihalation underlayer and/or pelloid layer in the photographic element according to the present invention is preferably present in an amount of 0.4 g/m$^2$ or less, more preferably in an amount of 0.4 g/m$^2$ or less and 0.05 g/m$^2$ or greater, still more preferably in an amount of 0.35 g/m$^2$ or less and 0.05 g/m$^2$ or greater and most preferably in an amount of 0.3 g/m$^2$ or less and 0.1 g/m$^2$ or greater, for example in an amount of about 0.1 g/m$^2$ or about 0.2 g/m$^2$.

As explained above, any suitable coating system can be used to prepare the photographic element according to the present invention. Generally speaking, the antihalation underlayer can be coated as a single layer onto which the remaining layers e.g. silver halide emulsion layer(s), supercoat etc, of the photographic element can be coated simultaneously or as separate layers. Alternatively, the photographic element can be manufactured using coating of multi-layers i.e. a single coating operation is used to coat simultaneously the antihalation underlayer and the remaining layers of the photographic element.

For coating the antihalation underlayer as a single layer a number of coating arrangements can be used. Examples include bead coating, extrusion coating and curtain coating.

In bead coating a conventional narrow-gap bead coating hopper could be used. Wet coverage would be expected to be in the range 15-45 ml/m$^2$. Due to the low gel and latex copolymer coverages, the melt viscosity will be below the normal operating range for bead coating a single layer (3-10 cP) and a gel thickener will be required to boost solution viscosity to acceptable levels to give good coating quality, and also improve setting in the chill section of the drier to avoid drying disturbance. The AHU solution is likely to have a low high-shear viscosity so relatively low hopper suctions will be required (0.2-1.0 inches water gauge (iwg)) to avoid pull-through (where coating solution is lost via the suction system to drain).

Extrusion coating at lower wet coverages (10-30 ml/m$^2$) would also be a viable option, again with thickener being used, but the usable viscosity range would extend to 1-30 cP. Polymers to aid chill-setting may still be required to allow relatively normal drying conditions to be used. Alternatively, the coating could be dried using pre-set drying i.e. drying without the solution setting. In this case it is necessary to ensure the surface of the coated solution is not disturbed by the drying. Another option would be a slide over extrusion system where the bottom element of a bead hopper is replaced by an extrusion blade: similar viscosity and wet coverage rules would apply.

More traditional coating methods could also be used to coat this single layer: for example Roller Coating with an air knife to control coverage would be usable, especially at lower wet coverages (1-10 ml/m$^2$) thus reducing the need for thickeners as component concentrations rise. This technique is often used to apply low wet coverages.

If single layer coating is used, the remaining layers of the photographic element may be coated conventionally at a second coater as described above, e.g. by bead, curtain or slide over extrusion coating. In all cases a low level of an easily re-wettable surfactant is beneficial in achieving good AHU coating quality whilst allowing the subsequent layers to be coated easily on top of it.

For coating the AHU as the bottom layer of a multilayer pack the options include amongst others: bead coating, slide over extrusion coating and curtain coating.

In bead coating, a conventional narrow-gap bead coating hopper could be used. Wet coverage would be expected to be in the range 5-45 ml/m$^2$. Due to the low gelatin and latex copolymer coverages, the melt viscosity will be below the normal operating range for bead coating a single layer (3-10 cP) and a gel thickener will be required to boost solution viscosity to acceptable levels to give good coating quality. If the lower end of the wet coverage range is used then water migration to the higher gel concentration layers above the AHU will be expected to reduce this need for thickener and also improve setting. Addition of surfactant would not necessarily be needed for an AHU layer in this instance.

A slide over extrusion system (where the bottom element of a bead hopper is replaced by an extrusion blade) is again an option, viscosity and wet coverage limits being in the region of 5-45 ml/m$^2$ and the viscosity in the range 1-30 cP. Again, addition of surfactant is not necessarily required for the AHU layer.

With curtain coating: higher viscosities are required for the AHU layer (5 cP upwards) and addition of surfactant is beneficial in order to improve the coating quality of the antihalation underlayer. It will be appreciated that any suitable coating method can be used that is capable of coating a thin antihalation underlayer onto a suitable support. In particular, in the examples above, the ultra-thin AHU could also be coated as the first pass on a single coating station coating-machine, and the conventional photographic emulsion layers coated as a second pass.

EXAMPLES

The invention will now be exemplified by the following examples.

Example 1

An antihalation underlayer was prepared for a red-sensitive PCB film

To deionised water (3666.4 g) was added a dry bone gelatin (10.0 g) manufactured by Nitta Gelatin Inc. The gel was allowed to swell at 25° C. for 20 minutes before being melted, with stirring, at 40° C. The pH was adjusted to 5.1±0.05. A solution (8.0 ml) of Aerosol OT® surfactant (13.33 g in 1 kg) was added, so that the surfactant solution represented 0.2% w/w of the final coating solution. Then a dye dispersion (110.0 g) was added: the dye had a structure of formula 1 and was 10% w/w in water.

Formula 1

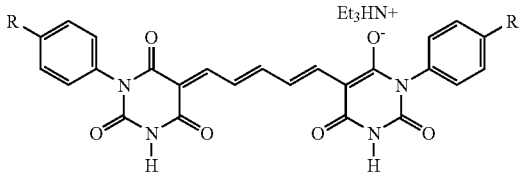

R = $CO_2H$

Finally, deionised water was added so as to bring the coating solution weight up to 4000.0 g. The solution was coated conventionally by a slide hopper technique on to polyethylene terephthalate film support at a wet coverage of 40 ml/$m^2$, so as to deliver dry coverages of 100 mg gelatin/$m^2$ and 110 mg dye/$m^2$.

Example 2

An antihalation underlayer was prepared for a blue-sensitive PCB film

To deionised water (3666.4 g) was added a dry bone gelatin (10.0 g) manufactured by Nitta Gelatin Inc. The gel was allowed to swell at 25° C. for 20 minutes before being melted, with stirring, at 40° C. The pH was adjusted to 5.1±0.05. A solution (8.0 ml) of Aerosol OT® surfactant (13.33 g in 1 kg) was added, so that the surfactant solution represented 0.2% w/w of the final coating solution. Then a dye dispersion (107.6 g) was added: the dye had structure of Formula 2 and was 10% w/w in water.

Formula 2

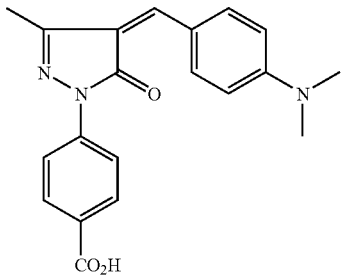

Finally, deionised water was added so as to bring the coating solution weight up to 4000.0 g. The solution was coated conventionally by a slide hopper technique on to polyethylene terephthalate film support at a wet coverage of 40 ml/$m^2$, so as to deliver dry coverages of 100 mg gelatin/$m^2$ and 107.6 mg dye/$m^2$.

In both examples, suitable light sensitive photographic emulsion layers could then be coated on top of the AHU.

Humidity Expansion

Table 1 below show results of humidity expansion tests done for each of two coatings A and B, the former being a coating according to the present invention where the normally thick underlayer has been omitted and replaced by the thin AHU only. The latter coating is a comparison and contains the normal underlayer. The dry coverages of the various layers are shown in Table 2.

Table 1 shows the % change in dimension per % change in relative humidity (RH). Eight readings were made for each film and the mean and the standard deviation calculated.

The advantage of the invention is clearly seen.

TABLE 1

| | Coating A (Invention) | Coating B (Comparison) |
|---|---|---|
| Mean | 0.0010 | 0.0011 |
| Standard Deviation | 0.000060 | 0.000064 |

Table 2 below shows the gelatin and latex copolymer coverages of the individual layers in each coating. The coatings were supported on polyethylene terephthalate film base. It is known that this has a mean % change in dimension per % change in relative humidity of 0.0008. Accordingly, the additional % change in dimension per % change in relative humidity due to the coatings was 0.0002 for the present invention and 0.0003 for the conventional coating. The invention therefore provides an approximate 33% improvement in this parameter. Given that many films in which this invention might be used are frequently provided in large sheets e.g. 24 inches×30 inches, an improvement in the % change in dimension per % change in relative humidity, can be significant.

TABLE 2

| | Coating A (invention) | | Coating B (comparison) | |
|---|---|---|---|---|
| Layer | Gelatin (g/$m^2$) | Polymer (g/$m^2$) | Gelatin (g/$m^2$) | Polymer (g/$m^2$) |
| Ultra thin AHU | 0.10 | 0 | None | None |
| Conventional AHU | None | None | 1.10 | 1.00 |
| Emulsion Layer | 1.94 | 1.16 | 1.94 | 1.16 |
| Interlayer | 0.98 | 0 | 0.98 | 0 |
| Supercoat | 0.49 | 0 | 0.49 | 0 |
| Total | 3.51 | 1.16 | 4.51 | 2.16 |

Wet Adhesion

The wet adhesion properties of a material according to the present invention were tested. A coating of a 0.15 g gelatin/$m^2$ thin AHU layer containing 0.11 g solid particle dye/$m^2$ and 0.15 g latex copolymer/$m^2$ was formed on a PET base. Conventional photographic emulsion layers, including a hardener, were coated thereon. After ensuring that the hardening reaction had gone to completion, good wet adhesion was observed. This was achieved either by incubating the coatings at 50° C. for 7 days, or, more preferably, by incorporating a humectant such as glycerol in the coating.

The invention claimed is:

1. A photographic element for use in graphic arts or in the manufacture of PCBs, which photographic element comprises:

a support;

a photographic emulsion layer; and, at least one of an antihalation underlayer and a pelloid layer, each of which antihalation underlayer and pelloid layer being present in an amount of 0.4 g/m$^2$ or less and comprising a vehicle and a solid particle dye.

2. A photographic element as claimed in claim 1, wherein each of the antihalation underlayer and/or pelloid layer is present in an amount of 0.35 g/m$^2$ or less and of 0.05 g/m$^2$ or greater.

3. A photographic element as claimed in claim 1-wherein each of the antihalation underlayer and/or pelloid layer is present in an amount of 0.3 g/m$^2$ or less and of 0.1 g/m$^2$ or greater.

4. A photographic element as claimed in claim 1, which comprises an antihalation underlayer or a pelloid layer.

5. A photographic element as claimed in claim 4, which comprises an antihalation underlayer.

6. A photographic element as claimed in claim 1, wherein the vehicle comprises a gelatin and latex copolymer mixture.

7. A photographic element as claimed in claim 1, wherein the vehicle is a gelatin.

8. A photographic element as claimed in claim 7, wherein the gelatin is selected from the group consisting of alkali treated gelatin, cattle bone gelatin, cattle hide gelatin, acid treated gelatin and pigskin gelatin, or gelatin derivatives from the group consisting of acylated gelatin, phthalated gelatin, oxidized gelatin and diamine derivatized gelatin.

9. A photographic element as claimed in claim 1, wherein the vehicle is a hydrophilic water-permeable colloid.

10. A photographic element as claimed in claim 9, in which the vehicle comprises one or more materials selected from the group consisting of synthetic polymeric peptizers, carriers, and/or binders such as poly(vinyl alcohol), poly (vinyl lactams), acrylamide polymers, polyvinyl acetals, polymers of alkyl and sulphoalkyl acrylates and methacrylates, hydrolysed polyvinyl acetates, polyamides, polyvinyl pyrrolidone, methacrylamide copolymers, and the like, latex copolymer or cellulose such as carboxymethyl cellulose.

11. A photographic element as claimed in claim 1, wherein the antihalation underlayer and/or pelloid layer comprises a thickening agent.

12. A photographic element as claimed in claim 11, wherein the thickening agent is sodium polystyrene sulphonate.

13. A photographic element as claimed in claim 1, wherein the support is made of a material selected from the group consisting of, acetate, reflective paper, aluminium, polymeric films, cellulose esters, cellulose triacetate and cellulose diacetate, polyesters of dibasic aromatic carboxylic acids with divalent alcohols, poly(ethylene-terephthalate), poly(ethylene-naphthalate), paper and polymer coated paper.

14. A photographic element as claimed in claim 1, wherein the dye has a structure

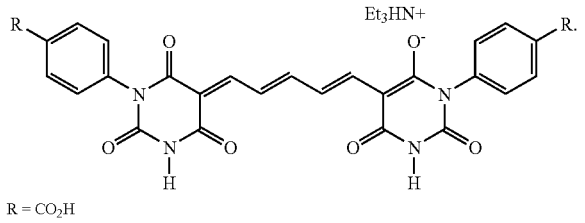

15. A photographic element as claimed in claim 1, in which the dye has a structure

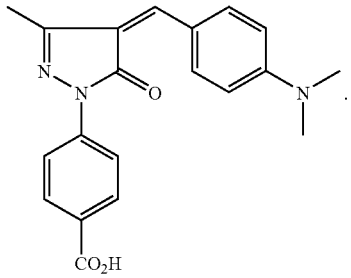

16. A method of manufacturing a photographic element for use in graphic arts or in the manufacture of PCBs, said method comprising coating a support with an antihalation underlayer in an amount of 0.4 g/m$^2$ or less, said antihalation underlayer comprising a vehicle and a solid particle dye; and coating said antihalation underlayer with at least one photographic emulsion layer, wherein the antihalation underlayer and the at least one photographic emulsion layer are coated separately.

17. A method as claimed in claim 16, wherein the antihalation underlayer is coated at a first station of a two station coating system and the at least one photographic emulsion layer is coated at a second station of the two station coating system.

18. A method as claimed in claim 16, wherein the antihalation underlayer is coated in a first pass through a single station coating system and the at least one photographic emulsion layer is coated in a second pass through the single station coating system.

19. A method of manufacturing a photographic element for use in graphic arts or in the manufacture of PCBs, said method comprising coating a support with an antihalation underlayer in an amount of 0.4 g/m$^2$ or less, said antihalation underlayer comprising a vehicle, a solid particle dye and a thickening agent compatible with the vehicle; and coating said antihalation underlayer with at least one photographic emulsion layer, wherein the antihalation underlayer and the at least one photographic emulsion layer(s) are coated substantially simultaneously in a multi-layer coating system.

20. A method as claimed in claim 19, wherein the thickening agent is sodium polystyrene sulphonate.

21. A method as claimed in claim 19, wherein the antihalation underlayer is coated in an amount of 0.3 g/m$^2$ or less and of 0.1 g/m$^2$ or greater.

22. A method as claimed in claim 19, wherein the vehicle comprises a gelatin and latex copolymer mixture.

23. A method as claimed in claim 19, wherein the vehicle is a gelatin.
24. A method as claimed in claim 19, wherein the vehicle is a hydrophilic water-permeable colloid.
25. A method as claimed in claim 19, wherein the dye has a structure
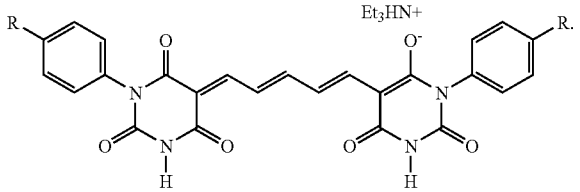
R = $CO_2H$
26. A method as claimed in claim 19, in which the dye has a structure
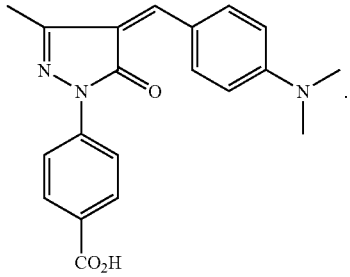
* * * * *